US008079779B2

(12) United States Patent
Lee

(10) Patent No.: US 8,079,779 B2
(45) Date of Patent: Dec. 20, 2011

(54) DEVICE FOR PULLING OUT A SHIP

(76) Inventor: Kyong-Hyung Lee, Seoul (KR)

( * ) Notice: Subject to any disclaimer, the term of this patent is extended or adjusted under 35 U.S.C. 154(b) by 0 days.

(21) Appl. No.: 12/653,010

(22) Filed: Dec. 7, 2009

(65) Prior Publication Data

US 2010/0196097 A1 Aug. 5, 2010

Related U.S. Application Data

(63) Continuation of application No. PCT/KR2008/003276, filed on Jun. 12, 2008.

(30) Foreign Application Priority Data

Jun. 12, 2007 (KR) ..... 10-2007-0057392

(51) Int. Cl.
*B63C 3/08* (2006.01)

(52) U.S. Cl. ..... 405/3; 405/2

(58) Field of Classification Search ..... 405/2, 3
See application file for complete search history.

(56) References Cited

U.S. PATENT DOCUMENTS 4,953,488 A * 9/1990 Heidtmann ..... 114/44
5,238,348 A * 8/1993 Reimer ..... 414/254
5,487,636 A * 1/1996 Mkrtchyan ..... 414/286
6,007,288 A * 12/1999 Maffett et al. ..... 414/281
6,162,003 A * 12/2000 Gruner ..... 414/281
7,112,007 B2 * 9/2006 Maffett et al. ..... 405/3
7,367,747 B2 * 5/2008 Maffett et al. ..... 405/1
2002/0176767 A1 * 11/2002 Gisselberg ..... 414/261

FOREIGN PATENT DOCUMENTS

JP 55015366 2/1980
JP 2183055 7/1990
JP 3253490 11/1991
JP 10278881 10/1998

* cited by examiner

*Primary Examiner* — John Kreck
(74) *Attorney, Agent, or Firm* — Cooper & Dunham LLP

(57) ABSTRACT

An apparatus for hoisting a ship. A transfer truck located on the shore moves to the interior of a raising/lowering lift by means of a set of movable rails so as to be able to unload the ship floating on a water surface. Lift-side support blocks, which are spaced apart from each other, are gradually raised under water to float the ship on the water surface. Truck-side support blocks, which are spaced apart from each other in a manner similar to the lift-side support blocks, move to the interior of the raising/lowering lift. Thereby, the lift-side support blocks, which are spaced apart from each other, are lowered through gaps between the truck-side support blocks while crossing the truck-side support blocks so as to allow the ship to be safely unloaded.

17 Claims, 7 Drawing Sheets

[Fig. 1]
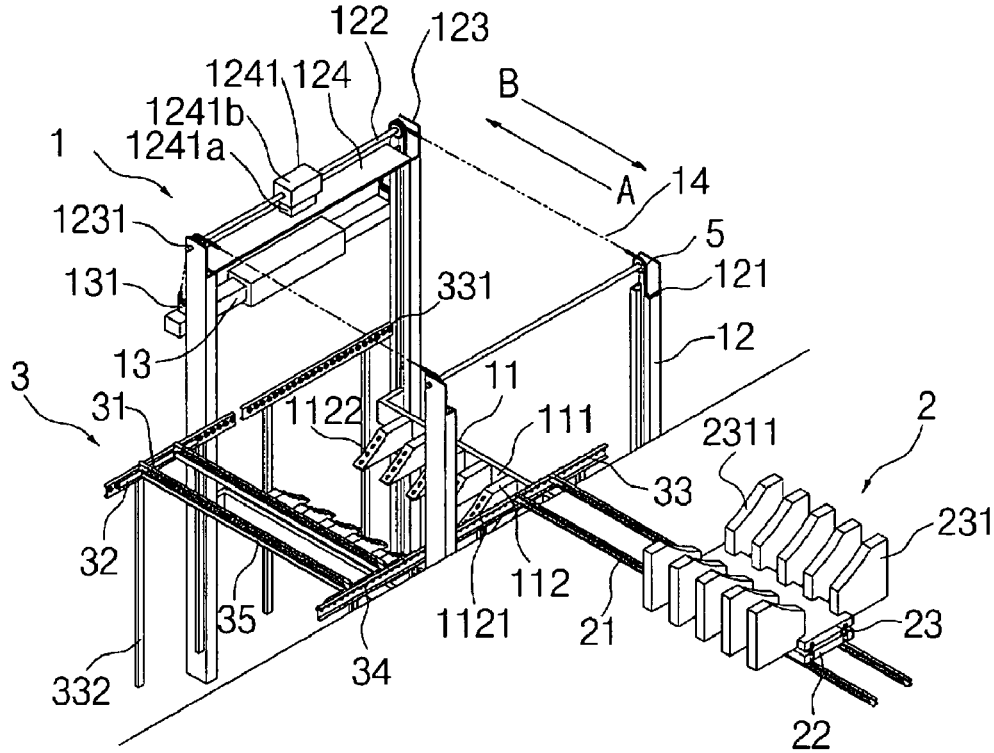
[Fig. 2]
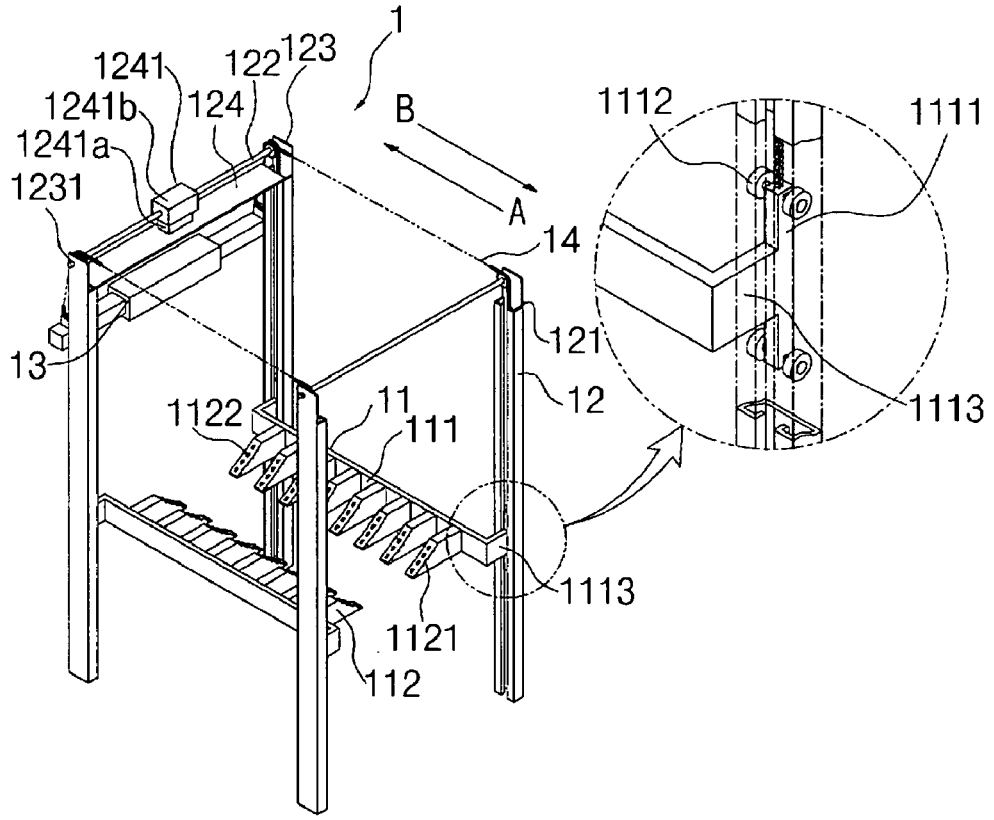

[Fig. 3]
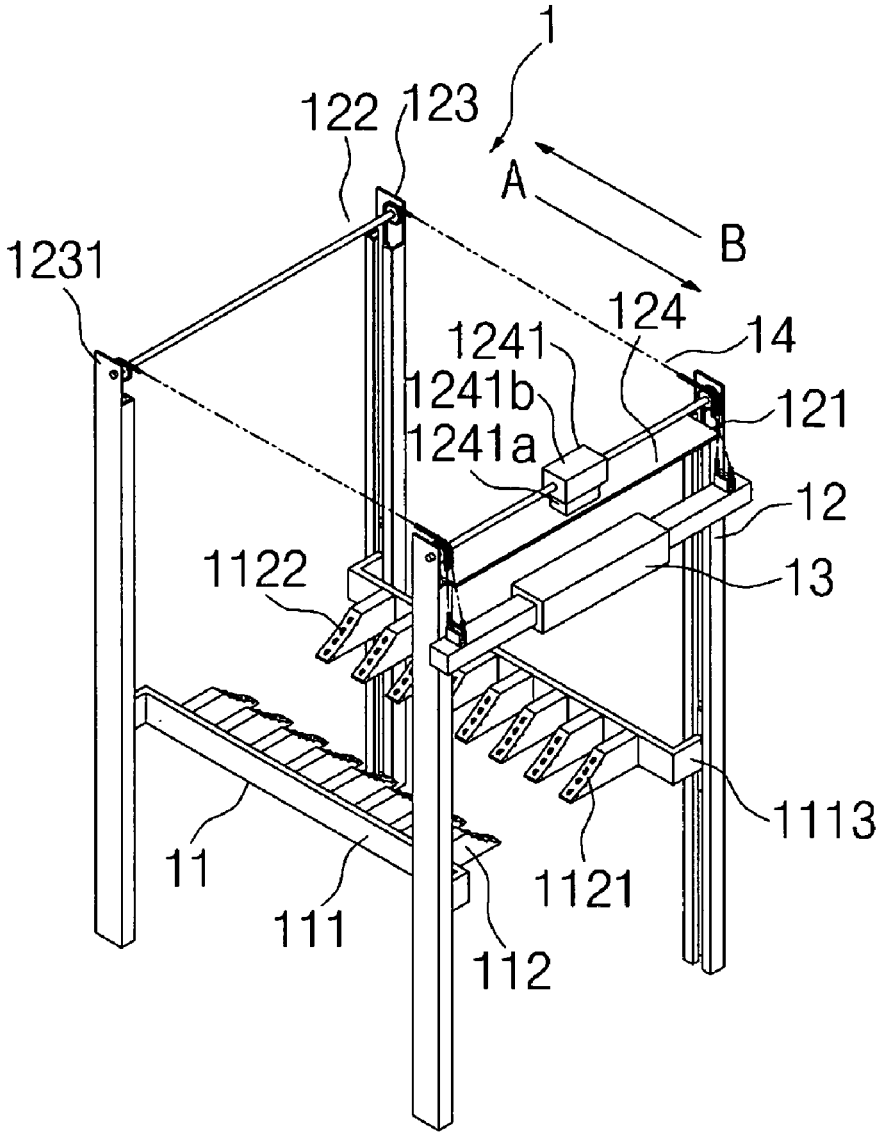
[Fig. 4]
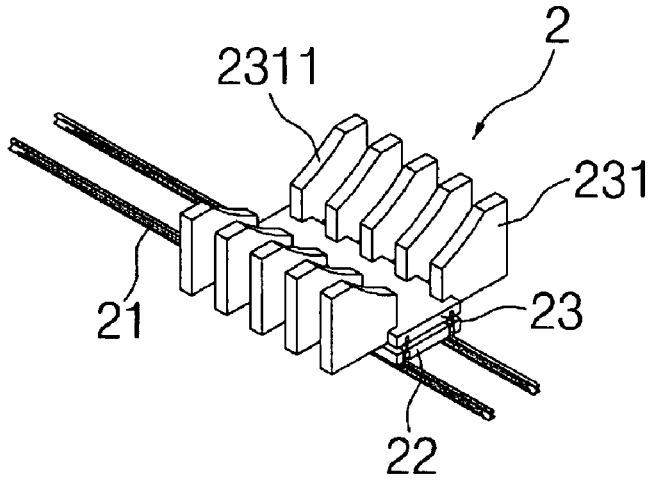

[Fig. 5]
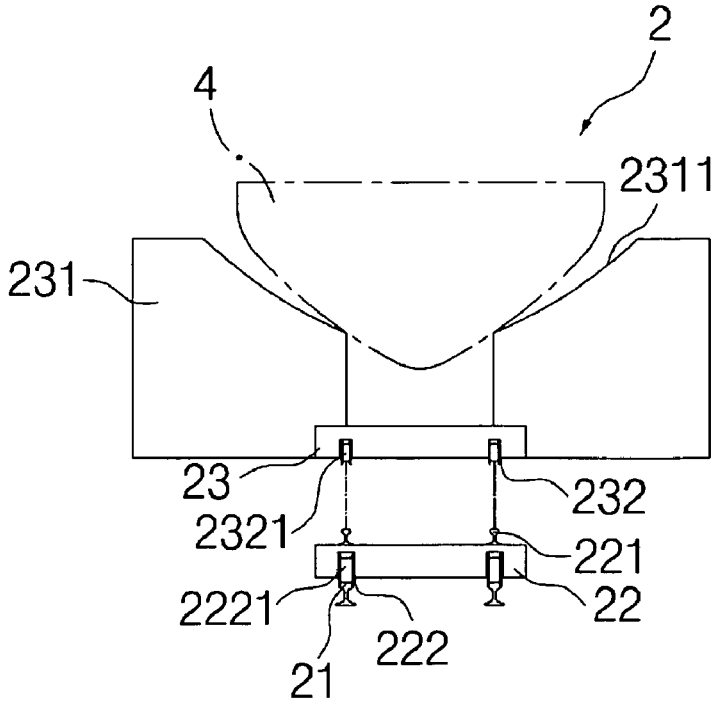
[Fig. 6]
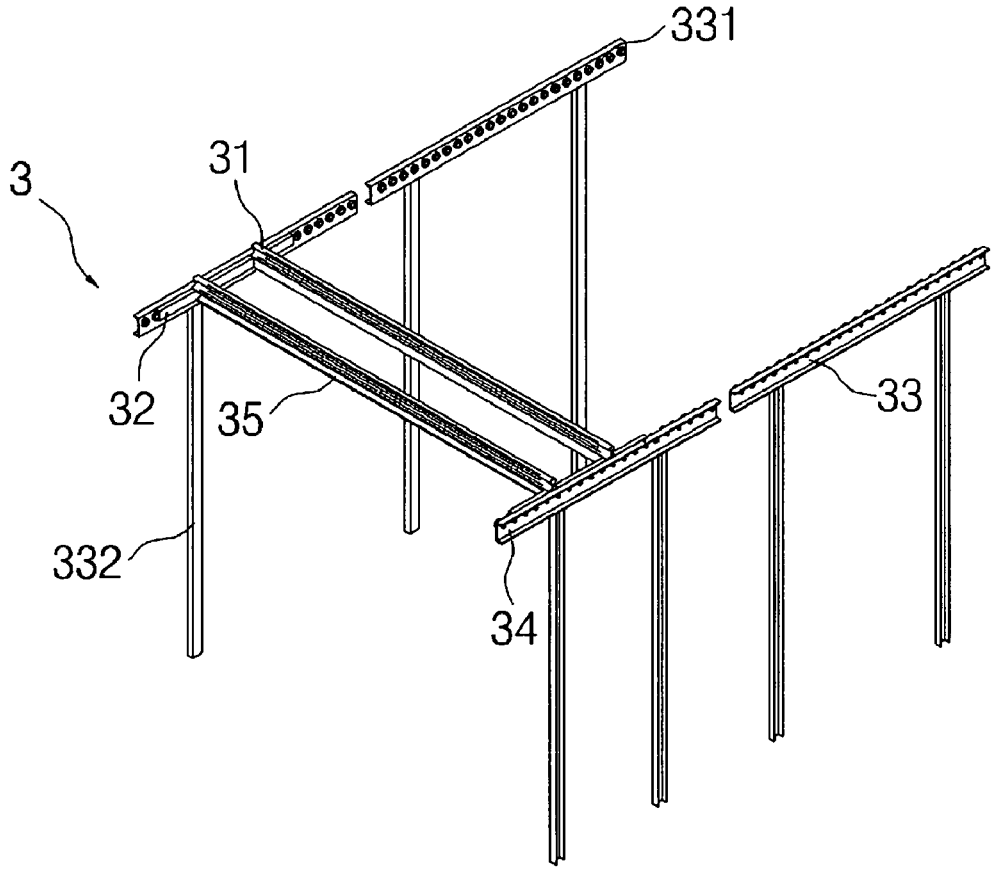

[Fig. 7]
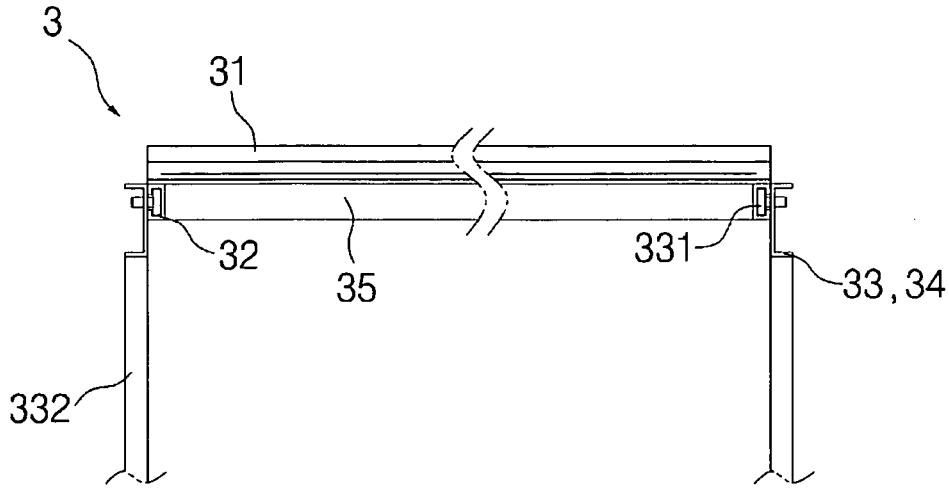
[Fig. 8]
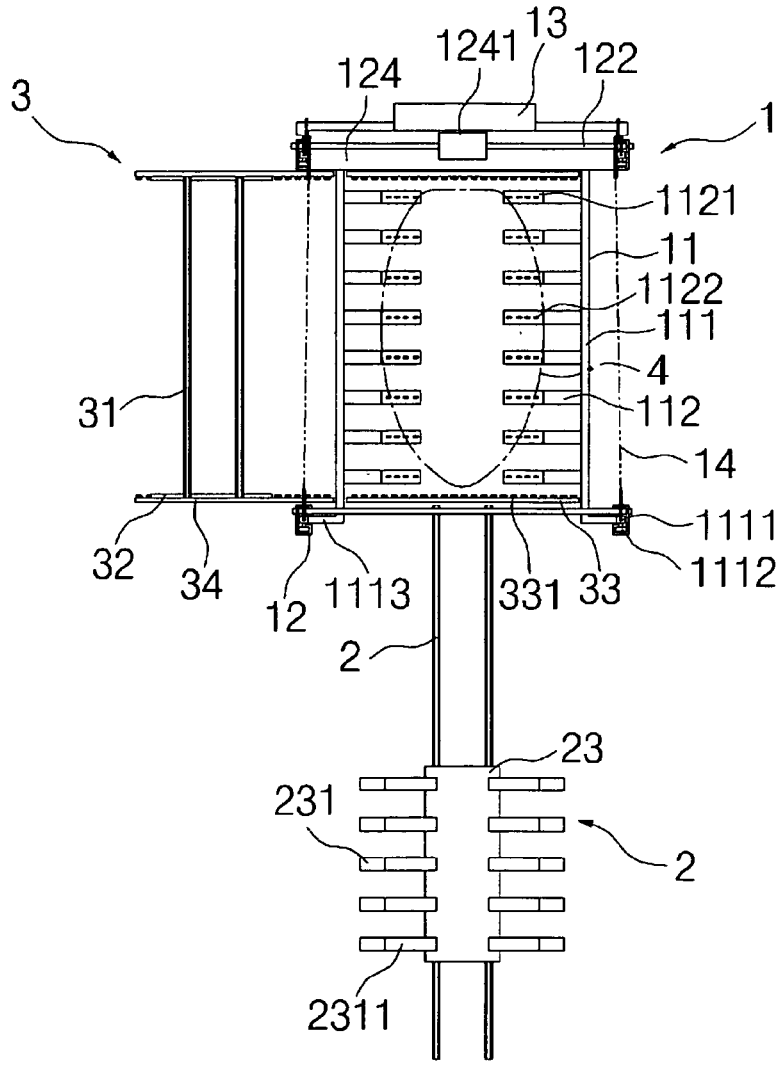

[Fig. 9]
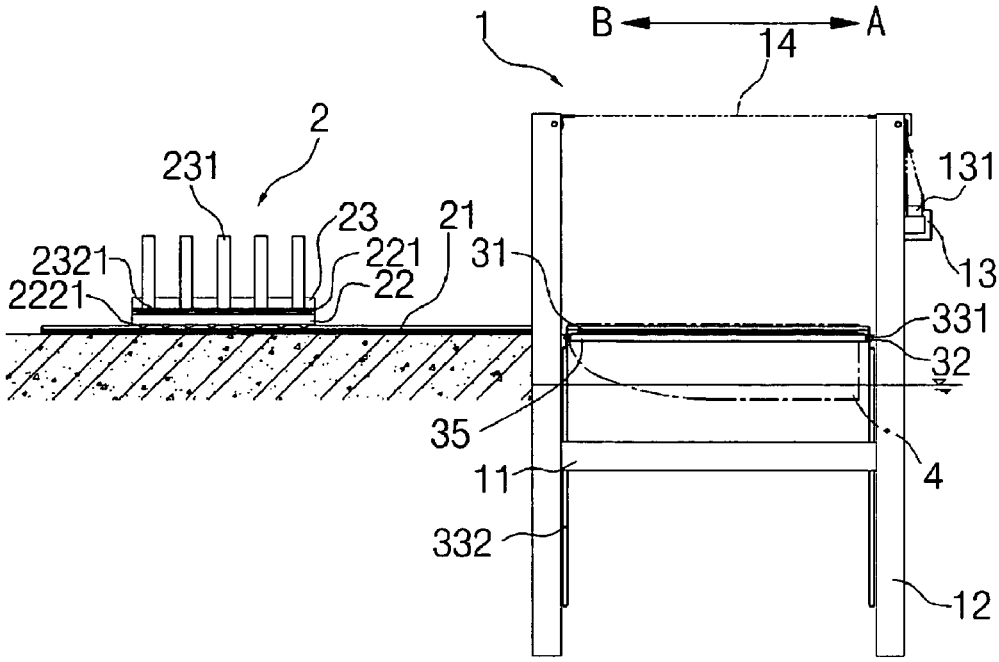
[Fig. 10]
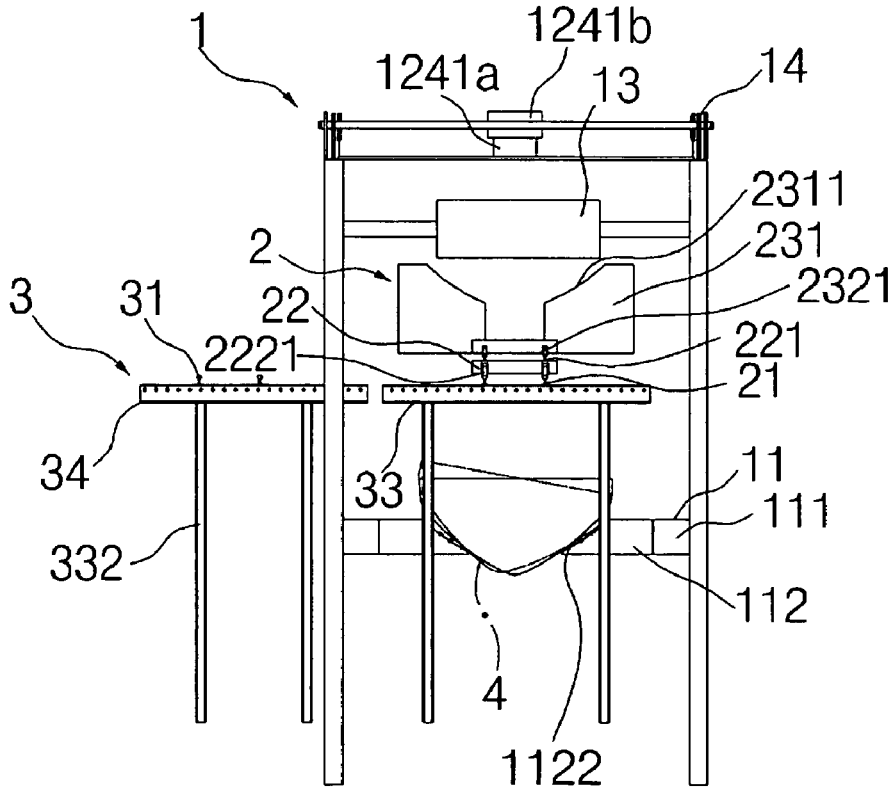

[Fig. 11]
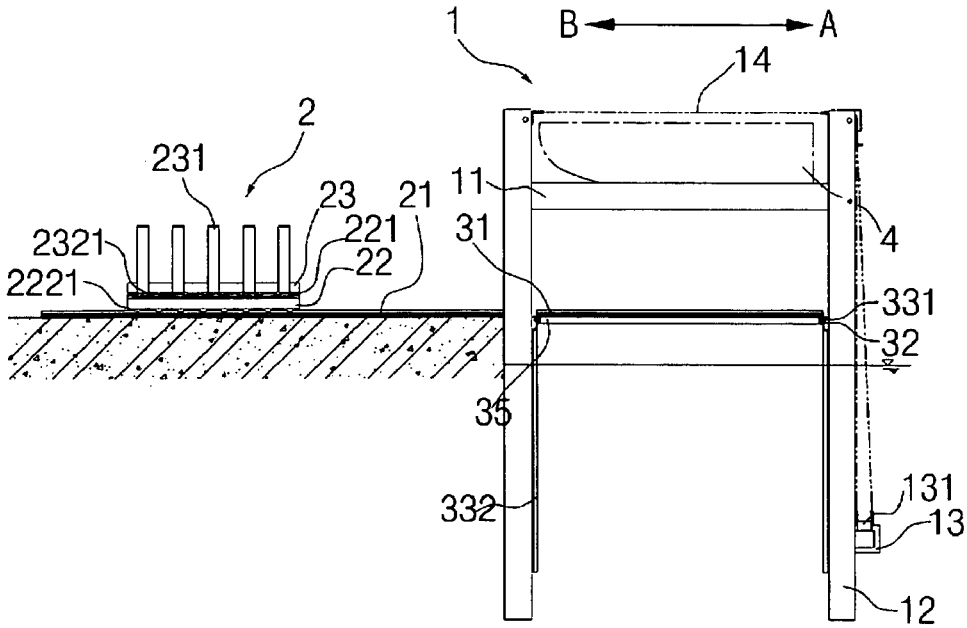
[Fig. 12]
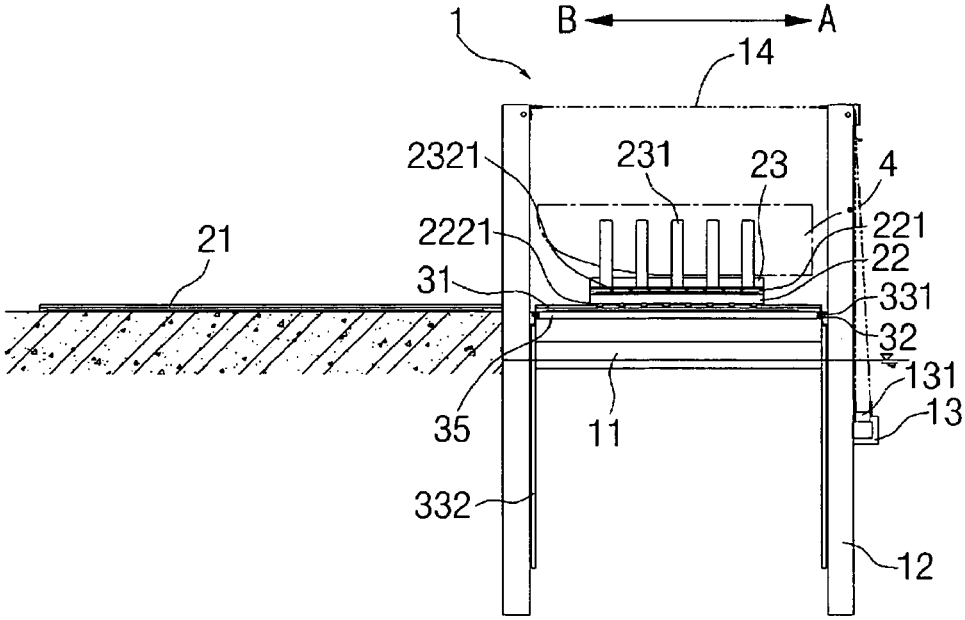

[Fig. 13]
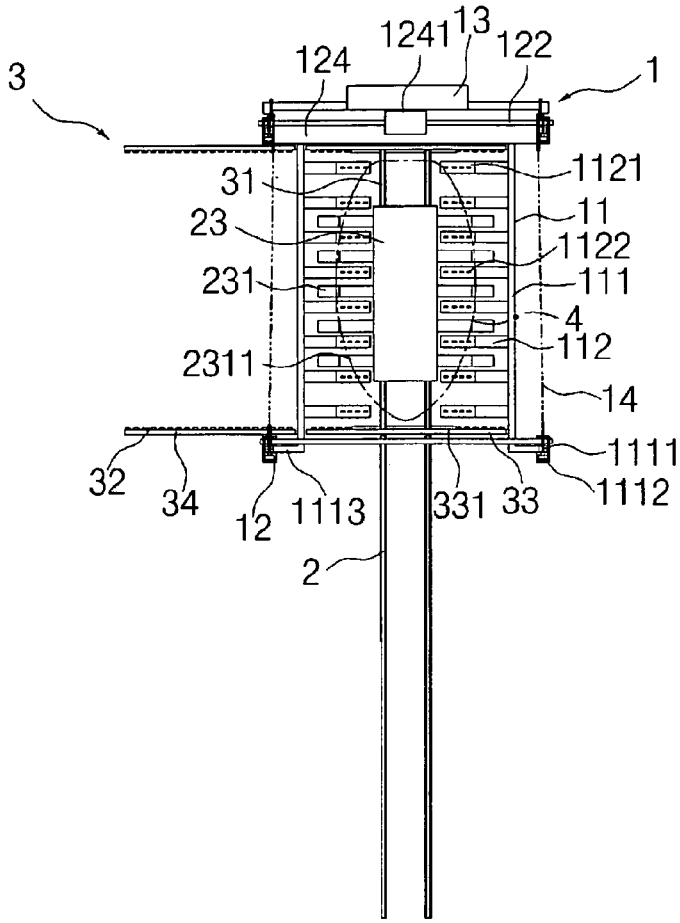
[Fig. 14]
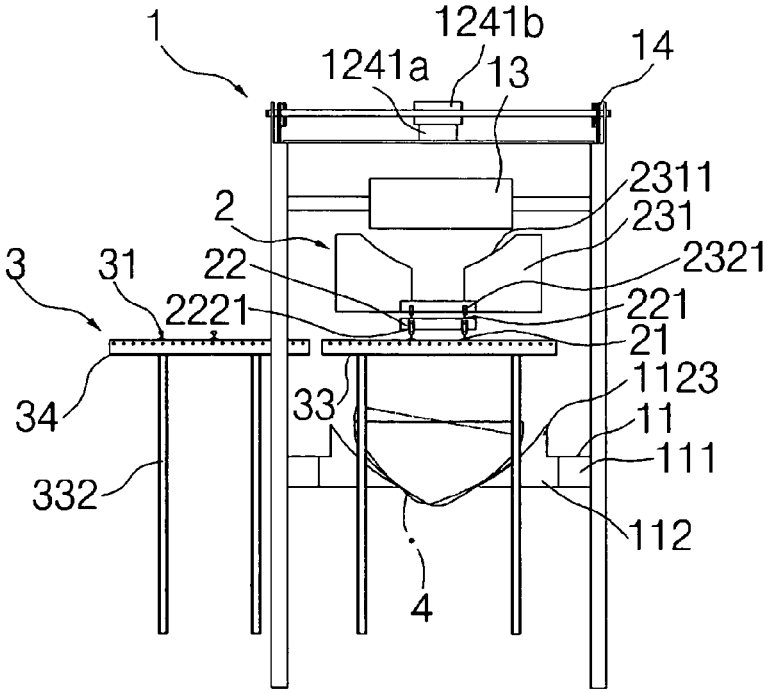

DEVICE FOR PULLING OUT A SHIP

REFERENCE TO RELATED APPLICATIONS

This application is a continuation of and claims the benefit of PCT International Application Number PCT/KR2008/003276 filed on Jun. 12, 2008 which is based on Korean Patent Application Number 10-2007-0057392 filed in Korea on Jun. 12, 2007 the disclosure of each which are incorporated herein by reference in their entirety.

TECHNICAL FIELD

The present invention relates, in general, to an apparatus for hoisting a ship and, more particularly, to an apparatus for hoisting a ship, in which a transfer truck located on the shore moves to the interior of a raising/lowering lift by means of a set of movable rails so as to be able to unload the ship floating on a water surface, and in which, lift-side support blocks spaced apart from each other are gradually raised under water to float the ship on the water surface, truck-side support blocks spaced apart from each other in a manner similar to the lift-side support blocks move to the interior of the raising/lowering lift, and thereby the lift-side support blocks, which are spaced apart from each other, are lowered through gaps between the truck-side support blocks while crossing the truck-side support blocks so as to allow the ship to be safely unloaded.

BACKGROUND ART

As the level of life is improved, a variety of leisure activities are increased. Among these leisure activities, leisure activities associated particularly with water in the summer, for instance water-skiing that is racing between small-sized boats having a motor, have recently undergone a sharp increase in popularity. In this manner, as various water leisure activities employing a small-sized boat as indispensable equipment have increased, the small-sized boats are also subjected to abrupt distribution. Thus, expense of and demand for the small-sized boats have abruptly increased as well. In particular, in the case of the small-sized boat used for boat racing, the small-sized boat is operated at severe conditions of high speed, so that more frequent and rapid repair is required. However, few apparatuses are suitable to easily and rapidly hoist for the purpose of repairing various small-size boats including ones for boat racing. As described above, the fact that few apparatuses are suitable for hoisting and repairing small-sized boats is because various small-sized boats used for life-saving, inland patrol, and leisure activities are operated in rivers. In particular, since the small-sized boats are mainly operated in rivers or lakes, berthing facilities for anchoring and mooring the small-sized boats, particularly stationary facilities using wood, steel beam, concrete, etc. as in a quay or wharf, are generally unsuitable thereto except in special circumstances.

Thus, a barge that can freely move and anchor or moor small-sized boats as needed is generally used as a berthing facility in rivers or lakes. A conventional hoisting apparatus includes an apparatus (hereinafter, referred to as "basic hoisting apparatus") that installs an inclined ramp extending from the barge into the water, hooks a wire on the small-sized boat approaching an outer end of the inclined ramp, and winds the wire using, for instance, a winch, so that the small-sized boat hooked by the wire is gradually hoisted along the inclined ramp.

The basic hoisting apparatus is the simplest structure, and has an advantage in that the cost is low. However, two or more lines of wire must be manually hooked on two or more portions of the small-sized boat and be hoisted one by one, and the small-sized boat and the winch are still connected with each other by the wire after the small-sized boat is hoisted. In the case in which the force pulling the wire to hoist the small-sized boat is unbalanced, the left-hand and right-hand sides of the small-sized boat become unbalanced and lean to one side, impeding the repair according to the circumstances. Since the inclined ramp extends from the barge into the water, the inclined ramp has a possibility of being collided with by another small-sized boat going through the vicinity of the barge.

DISCLOSURE OF INVENTION

Technical Problem

Accordingly, the present invention has been made in an effort to solve the problems occurring in the related art, and an object of the present invention is to provide an apparatus for hoisting a ship, in which upper portions of a set of lift-side support blocks and a set of truck-side support blocks are shaped so as to correspond to the lower outer surface of a hull of the ship, thereby enabling the ship to be more stably placed on the lift-side support blocks and the truck-side support blocks when the ship is placed on the lift-side support blocks and the truck-side support blocks.

Another object of the present invention is to provide an apparatus for hoisting a ship, in which lift-side support blocks and truck-side support blocks are spaced apart from each other, and the lift-side support blocks cross the truck-side support blocks through spaced gaps when the lift-side support blocks move up and down, thereby making it possible to safely unload the ship from the lift-side support blocks to the truck-side support blocks.

Another object of the present invention is to provide an apparatus for hoisting a ship, in which inner and outer transfer frames for guiding a set of movable rails are installed inside and outside a raising/lowering lift, thereby enabling a transfer truck to be safely displaced to the interior of the raising/lowering lift as needed.

Another object of the present invention is to provide an apparatus for hoisting a ship, in which a set of movable rails is installed on outer transfer frames, and move to inner transfer frames inside a raising/lowering lift so as to be aligned with a set of stationary rails installed on the shore, thereby enabling a transfer truck to be safely displaced from the stationary rails to the interior of the raising/lowering lift.

Another object of the present invention is to provide an apparatus for hoisting a ship, in which a seat of each lift-side support block is provided with a plurality of rollers, thereby enabling left-hand and right-hand sides of the ship to be balanced by rotation of the rollers installed on the seat of each lift-side support block when the lower outer surface of a hull of the ship is placed on the seat of each lift-side support block.

Another object of the present invention is to provide an apparatus for hoisting a ship, in which a balance weight is connected to a set of chains that is connected to the upper portion of a set of lift-side support blocks and then extends outwards through the channel of a set of lift guides, thereby making it possible to hoist the lift-side support blocks on which the ship is placed using the weight of the balance weight and the driving force of a motor when the ship is placed on the lift-side support blocks.

Another object of the present invention is to provide an apparatus for hoisting a ship, in which the truck body and palette of a transfer truck can be separated from each other, in which the ship hoisted by a raising/lowering lift is unloaded onto a set of truck-side support block of the palette and then is transferred to a ship safekeeping place, in which the palette is separated from the truck body and is preserved at the ship safekeeping place, and in which another palette is coupled to the truck body, thereby replacing a plurality of palettes when used.

Technical Solution

In order to achieve the above object, according to a first embodiment of the present invention, there is provided an apparatus for hoisting a ship, which comprises a raising/lowering lift, which hoists the ship floating on a water surface under water, a transfer truck, which moves forwards to an interior of the raising/lowering lift, receiving the hoisted ship for unloading, moves backwards to transfer the unloaded ship to the shore, and a set of movable rails, which is displaced to allow the transfer truck to move forwards to the interior of the raising/lowering lift.

According to a second embodiment of the present invention, the raising/lowering lift includes a set of lift platforms moving up and down.

According to a third embodiment of the present invention, each of the lift platforms includes a plurality of lift-side support blocks spaced apart from each other.

According to a fourth embodiment of the present invention, the lift-side support blocks are shaped so as to correspond to the lower outer surface of a hull of the ship.

According to a fifth embodiment of the present invention, each of the lift-side support blocks further includes a support guard, which extends from an upper surface thereof such that the ship is not unbalanced by waves.

According to a sixth embodiment of the present invention, the transfer truck includes a truck body moving backwards and forwards, and a palette detachably installed on the truck body.

According to a seventh embodiment of the present invention, the palette includes a plurality of truck-side support blocks spaced apart from each other.

According to an eighth embodiment of the present invention, the truck-side support blocks are shaped so as to correspond to the lower outer surface of a hull of the ship.

According to a ninth embodiment of the present invention, the lift-side support blocks and the truck-side support blocks cross each other through gaps, which are defined in an overlapping manner when the lift-side support blocks are lowered after the truck-side support blocks move forwards to the interior of the raising/lowering lift.

According to a tenth embodiment of the present invention, the raising/lowering lift further includes a set of lift guides guiding upward and downward movement of the lift platform, a set of chain transmitting the driving force of a driver such that the lift platforms move up and down, and a balance weight connected with the chains and making possible the upward and downward movement of the lift platforms.

According to an eleventh embodiment of the present invention, the movable rails include rails for transferring the transfer truck, outer transfer frames provided outside the raising/lowering lift, and inner transfer frames provided inside the raising/lowering lift.

According to a twelfth embodiment of the present invention, the rails of the movable rails move between the outer transfer frames and the inner transfer frames.

According to a thirteenth embodiment of the present invention, the lift-side support blocks include rollers enabling left-hand and right-hand sides of the ship to be balanced when the ship is placed on the lift-side support blocks.

Advantageous Effects

According to the present invention, the upper portions of the lift-side support blocks and the truck-side support blocks are shaped so as to correspond to the lower outer surface of the hull of the ship, so that the apparatus for hoisting a ship enables the ship to be more stably placed on the lift-side support blocks and the truck-side support blocks when the ship is placed on the lift-side support blocks and the truck-side support blocks.

The lift-side support blocks and the truck-side support blocks are spaced apart from each other, and the lift-side support blocks cross the truck-side support blocks through the spaced gaps when the lift-side support blocks move up and down, so that the apparatus for hoisting a ship makes it possible to safely unload the ship from the lift-side support blocks to the truck-side support blocks.

The inner and outer transfer frames for guiding the movable rails are installed inside and outside the raising/lowering lift, so that the apparatus for hoisting a ship enables the transfer truck to be safely displaced to the interior of the raising/lowering lift as needed.

The rails of the movable rails are installed on the outer transfer frames, and move to the inner transfer frames inside the raising/lowering lift so as to be aligned with the stationary rails installed on the shore, so that the apparatus for hoisting a ship enables the transfer truck to be safely displaced from the stationary rails to the interior of the raising/lowering lift.

The seat of each lift-side support block includes a plurality of rollers, so that the apparatus for hoisting a ship enables the left-hand and right-hand sides of the ship to be balanced by rotation of the rollers installed on the seat of each lift-side support block when the lower outer surface of the hull of the ship is placed on the seat of each lift-side support block.

The balance weight is connected to the chains, which is connected to the upper portions of the lift-side support blocks and then extends outwards through the channels of a set of lift guides, so that the apparatus for hoisting a ship makes it possible to hoist the lift-side support blocks on which the ship is placed using the weight of the balance weight and the driving force of the motor when the ship is placed on the lift-side support blocks.

The truck body and the palette of the transfer truck can be separated from each other, and the ship hoisted by the raising/lowering lift is unloaded onto the truck-side support blocks of the palette, and then is transferred to the ship safekeeping place. Subsequently, the palette is separated from the truck body, and is preserved at the ship safekeeping place, and another palette is coupled to the truck body. As a result, the apparatus for hoisting a ship can replace a plurality of palettes when used.

BRIEF DESCRIPTION OF THE DRAWINGS

FIG. 1 is a perspective view illustrating an apparatus for hoisting a ship according to an exemplary embodiment of the present invention;

FIG. 2 is a front perspective view illustrating a raising/lowering lift in an apparatus for hoisting a ship according to an exemplary embodiment of the present invention;

FIG. 3 is a rear perspective view illustrating a raising/lowering lift in an apparatus for hoisting a ship according to an exemplary embodiment of the present invention;

FIGS. 4 and 5 are a perspective view and a front view illustrating a transfer truck in an apparatus for hoisting a ship according to an exemplary embodiment of the present invention;

FIGS. 6 and 7 are a perspective view and a front view illustrating a movable rail set in an apparatus for hoisting a ship according to an exemplary embodiment of the present invention;

FIGS. 8 through 10 are operational views illustrating the state in which a raising/lowering lift in an apparatus for hoisting a ship according to an exemplary embodiment of the present invention is lowered;

FIG. 11 is an operational view illustrating the state in which a raising/lowering lift in an apparatus for hoisting a ship according to an exemplary embodiment of the present invention is raised;

FIGS. 12 and 13 are operational views illustrating the state in which a movable rail in an apparatus for hoisting a ship according to an exemplary embodiment of the present invention moves forwards; and FIG. 14 is a front view illustrating an apparatus for hoisting a ship according to another exemplary embodiment of the present invention.

DESCRIPTION OF SYMBOLS OF THE MAIN PARTS IN THE DRAWINGS

1: raising/lowering lift 11: lift platform
111: lift frame 112: lift-side support block
1121: support seat 1122: seat roller
12: lift guide 121: guide channel
122: fixing axle 123: axle fixing frame
124: driver support 13: balance weight
14: chain 2: transfer truck
21: stationary rail 22: truck body
221: palette rail 222: stationary rail groove
23: palette 231: truck-side support block
31: rail 3: movable rail
33: inner transfer frame 34: outer transfer frame
331: transfer frame roller
332: transfer frame support post
35: rail support 4: ship
5: sprocket

BEST MODE FOR CARRYING OUT THE INVENTION

Hereinafter, an apparatus for hoisting a ship according to an exemplary embodiment of the present invention will be described with reference to the accompanying drawings.

FIG. 1 is a perspective view illustrating an apparatus for hoisting a ship according to an exemplary embodiment of the present invention. FIG. 2 is a front perspective view illustrating a raising/lowering lift in an apparatus for hoisting a ship according to an exemplary embodiment of the present invention. FIG. 3 is a rear perspective view illustrating a raising/lowering lift in an apparatus for hoisting a ship according to an exemplary embodiment of the present invention.

Referring to FIGS. 1 and 2, the apparatus for hoisting a ship comprises a raising/lowering lift 1, which hoists the ship 4, a transfer truck 2, which transfers the hoisted ship 4 to the shore, and a set of movable rails 3, which moves to allow the ship to be unloaded onto the transfer truck 2.

Here, the ship 4 is a target ship hoisted by the apparatus for hoisting a ship. Further, the apparatus for hoisting a ship according to the present invention preferably has a size compatible with the ship 4.

The raising/lowering lift 1 is installed on the waterside, and is for hoisting the ship 4 floating on the water surface. The raising/lowering lift 1 includes a set of lift platform 11 supporting the ship 4, a set of lift guides 12 guiding upward and downward movement of the lift platforms 11, a balance weight 13 adjusting a speed of the upward and downward movement of the lift platforms 11, and a set of chains 14 fixed to the lift platforms 11 such that the lift platforms 11 can move up and down.

Each of the lift platforms 11 has a C shape overall when viewed from the top, and is shaped so that a set of blocks protrudes to one side. The lift platforms 11 move up and down along the lift guides 12, which will be described below, thereby allowing the ship floating on the water surface to be placed thereon. The lift platforms 11 are made up of two lift platforms in a pair so as to be able to support the lower outer surface of a hull of the ship in parallel, wherein each lift platform includes a lift frame 111 and a set of lift-side support blocks 112.

The lift frame 111 has a C shape overall when viewed from the top, and includes roller fixtures 1111 and lift rollers 1112 so as to be able to be displaced up and down along the lift guides 12 by a motor 1241*a* and the chains 14, which will be described below.

The roller fixtures 1111 are protrusions that protrude from respective guide insertion sections 1113, which are bent at left-hand and right-hand ends, "A" and "B" directional ends, of each lift frame 111 at a right angle. The roller fixtures 1111 are inserted into the lift guides 12, which will be described below, and can be moved up and down along the lift guides 12 by the motor 1241*a* and the chains 14 welded to upper ends thereof.

The lift rollers 1112 are fixed to upper and lower portions of the roller fixtures 1111, and are inserted into interior channels of the lift guides 12 such that the lift frames 111 can be raised and lowered.

Each of the lift-side support blocks 112 is a place where the ship 4 is placed and hoisted, and is made up of a plurality of lift-side support blocks, which are spaced apart from each other at regular intervals on the side opposite the side where the roller fixtures 1111 and the lift rollers 1112 are installed. The lift-side support blocks 112 can cross a pallet 23, which will be described below, when the lift platforms 11 are raised or lowered, and each lift-side support block thereof includes a support seat 1121 and a set of seat rollers 1122, which are in direct contact with the ship.

The support seat 1121 is generally shaped similar to the lower outer surface of the hull of the ship 4, because the lower outer surface of the hull of the ship 4 has a variety of shapes according to the kind of ship 4. The support seat 1121 comes into contact with the lower outer surface of the hull of the ship 4 when the lift platforms 11 are raised, so as to be able to safely hoist the ship 4.

Each of the seat rollers 1122 is made up of a plurality of rollers, which is provided to each support seat 1121. In the case in which the lift platforms 11 are raised in the state where a central line of the ship 4 deflects from a central line between the lift platforms 11, the ship 4 is placed on the lift-side support blocks 112 of the lift platforms 11 with one of the left-hand and right-hand sides thereof leaning to one side. For this reason, the seat rollers 1122 come into contact with the lower outer surface of the hull of the ship 4 to allow the left-hand and right-hand sides of the ship 4 to be balanced by rotation of the seat rollers 1122.

The embodiment of the aforementioned lift-side support blocks 112 is adapted to install the seat rollers 1122 on the support seat 1121 so as to allow them to balance the left-hand and right-hand sides of the ship 4 by the rotation of the seat rollers 1122 when the ship 4, the left-hand and right-hand sides of which is unbalanced, is placed thereon. However, according to another embodiment of the present invention, although the seat rollers 1122 are not installed on the support seat 1121, the ship 4, the left-hand and right-hand sides of which is unbalanced, is directly placed on the support seat 1121, and then the left-hand and right-hand sides of the ship 4 can be balanced by the weight of the ship 4 itself.

Further, according to another embodiment of the lift-side support blocks 112, as illustrated in FIG. 14, each of the lift-side support blocks 112 includes a support guard 1123 on an upper surface thereof which extends from the support seat 1121 thereof. The support guard 1123 prevents the ship 4 from moving backwards and forwards or from side to side by means of the waves or wind when the ship 4 is hoisted.

The lift guides 12 are made up of four lift guides, each of which has an overall "C" shape when viewed from the top. The lift guides 12 allow the guide insertion sections 1113, which are bent at the "A" and "B" directional ends of the lift frames 111 constituting the lift platforms 11, to be inserted thereinto, so that the lift platforms 11 can move up and down along the lift guides 12. The lift guides 12 include guide channels 121, fixing axles 122, axle fixing frames 123, and a driver support 124.

The guide channels 121 are portions that pass through the interiors of the respective lift guides 12 in a quadrilateral shape. The interior of each guide channel 121 has a width greater than a thickness of each roller fixture 1111, and particularly a distance between two lift rollers 1112 installed on each roller fixture 1111. Among the four faces defining each guide channel 121, one facing each lift frame 111 is provided with a gap from one end to the other end thereof corresponding to a thickness of each guide insertion section 1113 such that the lift platforms 11 can move up and down.

The fixing axles 122 are two cylindrical bars, one of which is fixed to two of the four lift guides 12 which are located in the "A" direction, and the other of which is fixed to the other two lift guides 12 which are located at the "B" directional ends of the lift frames 111. The fixing axle 122, which is fixed to the lift guides 12 which are located in the "A" direction, is equipped with the chains 14, the motor 1241*a*, and a speed reducer 1241*b*. The fixing axle 122, which is fixed to the lift guides 12 which are located in the "B" direction, is connected to the chains 14, and is rotated by driving force of the motor 1241*a* such that the lift platforms 11 can move up and down. Further, the fixing axle 122, which is located in the "A" direction, is provided with a total of four sprockets 5 at opposite ends thereof which are connected with the chains 14 and the balance weight 13, wherein two of the four sprockets 5 are fixed to one end of the fixing axle 122, and the other two are fixed to the other end of the fixing axle 122. Further, the fixing axle 122, which is located in the "B" direction, is provided with a total of two sprockets 5 at opposite ends thereof which are connected with the chain set 14, wherein one of the two sprockets 5 is fixed to one end of the fixing axle 122, and the other one is fixed to the other end of the fixing axle 122.

Each axle fixing frame 123 is a protrusion that protrudes upwardly from one face of each lift guide 12 in a quadrilateral shape, and includes a bar fixing hole 1231 at a predetermined position thereof such that the opposite ends of each fixing axle 122 can be fixed to the lift guides 12.

The driver support 124 is preferably formed of a rectangular plate, and is fixed to the ends of two lift guides 12, which are located in the "A" direction, at opposite ends thereof. The driver support 124 includes a driver 1241, and functions as a support for supporting the driver 1241 connected by the fixing axle 122 located in the "A" direction.

The driver 1241 includes the motor 1241*a* controlling operation of the lift platforms 11 that moves up and down, and the speed reducer 1241*b* reducing a speed of the motor 1241*a* when the lift platforms 11 approach a maximum raised position and a minimum lowered position.

The motor 1241*a* is connected by the fixing axle 122 located in the "A" direction. When the ship 4 is placed on the lift platforms 11, the motor 1241*a* is powered to control the upward and downward movement of the lift platforms 11. It is possible to apply a variety of well-known technologies for this purpose.

The speed reducer 1241*b* functions to gradually reduce the driving speed of the motor 1241*a* such that the lift platforms 11 operated by the power of the motor 1241*a* do not cause damage and noise by means of acceleration while the motor 1241*a* is operated between a point of time at which the raising of the lift platforms 11 come to an end after the ship 4 is placed on the lift platforms 11 and when the lowering of the lift platforms 11 comes to an end after the ship 4 placed on the lift platforms 11 is unloaded onto the transfer truck 2, which will be described below. It is possible to apply a variety of well-known technologies for this purpose.

Referring to FIG. 3, the balance weight 13 is preferably formed in a hexahedral shape, and is provided with fixing knobs 131 on opposite sides thereof such that the chains 14, which will be described below and is connected with the driver 1241, can be connected. When the lift platforms 11 are raised after the ship 4 is placed on the lift platforms 11, it can be raised by the self-weight of the balance weight 13 and the driving force of the motor 1241*a*. In contrast, when the lift platforms 11 are lowered, it is lowered by the driving force of the motor 1241*a*, and the balance weight 13 is raised by the chains 14 receiving the driving force of the motor 1241*a*. Thereby, the speed of the upward and downward movement of the lift platforms 11 can be adjusted.

The chains 14 are made up of two strings of chains, one end of each of which is inserted into the guide channels 121 of the lift guides 12 located in the "B" direction, and then are fixed to the upper end of the roller fixture 1111 of the lift platforms 11, and the other end of each of which is connected to the outer sprocket 5 at one end of the fixing axle 122 located in the "A" direction, is connected to the inner sprocket 5 at one end of the same fixing axle 122 via the fixing knob 131 installed on the balance weight 13, is inserted into the guide channels 121 of the lift guides 12 located in the "A" direction, and then is fixed to the upper end of the roller fixture 1111 of each lift platform 11. When the driver 1241 is powered to raise the lift platforms 11, the chains 14 between the fixing axles 122 located in the "A" and "B" directions move in the "A" direction. Thereby, the lift platforms 11 are raised by the chains 14 fixed to the roller fixtures 1111 thereof located in the "B" direction. Thus, the two strings of chains of the chains 14 between the balance weight 13 and the fixing axle 122 located in the "A" direction move downward, so that the balance weight 13 is lowered. In this manner, the two strings of chains 14 between the balance weight 13 and the fixing axle 122 located in the "A" direction, function to raise the lift platforms 11 located in the "A" direction. In contrast, when the lift platforms 11 are lowered, the operation of the chains is opposite to the aforementioned process. Thus, the operation and configuration of these chains will be omitted in order to avoid obscuring the subject matter of the present invention.

FIGS. 4 and 5 are a perspective view and a front view illustrating a transfer truck in an apparatus for hoisting a ship according to an exemplary embodiment of the present invention.

Referring to FIGS. 4 and 5, the transfer truck 2 is for transferring the ship 4, which is placed on and raised by the raising/lowering lift 1, to the shore, and includes a set of stationary rails 21, a truck body 22 moving along the stationary rails 21, and a palette 23 to which the ship 4 placed on the raising/lowering lift 1 is unloaded.

The stationary rails 21 are preferably formed in two rows in a shape similar to a railroad such that the truck body 22, which will be described below, can move. The stationary rails 21 are installed on the shore on the same line as the place where the raising/lowering lift 1 is located, and extends to an appropriate place to which the truck body 22 can transfer the ship 4 hoisted by the raising/lowering lift 1.

The truck body 22 is preferably formed in an overall hexahedral shape, and is located and supported on the stationary rail. The truck body 22 is adapted to cause the ship 4 hoisted by the raising/lowering lift 1 to be unloaded thereonto, and then to be able to move forwards and backwards, and includes a set of palette rails 221 and a set of stationary rail grooves 222.

The palette rails 221 are provided on top of the truck body 22, and are preferably formed in a shape similar to a railroad like the stationary rails 21. When the ship 4 is loaded on the palette 23 stacked on the truck body 22, it is transferred to an appropriate safekeeping place. The palette rails 221 allow the truck body 22 to be separated from the palette 23.

Each of the stationary rail grooves 222 is preferably formed in a quadrilateral shape at predetermined left-hand and right-hand positions of a lower surface of the truck body 22 so as to correspond to the stationary rails 21, and includes a set of truck moving rollers 2221, which is located on the stationary rails 21 such that the truck body 22 can move backwards and forwards.

Each of the truck moving rollers 2221 preferably has the shape of a wheel for a railroad train, and is made up of a plurality of truck moving rollers in the stationary rail grooves of the stationary rails 21, such that the transfer truck 2 facilitates moving to the movable rails 3, moves to the interior of the raising/lowering lift 1, is aligned with the stationary rails 21 with a gap. When the ship 4 is hoisted by the raising/lowering lift 1, the transfer truck 2 moves to the interior of the raising/lowering lift 1. At this time, the truck moving rollers 2221 come into direct contact with the top of the stationary rails 21, so that the transfer truck 2 can move backwards and forwards between the interior of the raising/lowering lift 1 and the shore.

The palette 23 is preferably formed in a hexahedral shape, which has a width smaller than that of each lift-side support block 112 formed on each lift platform 11 on the whole, and is located on top of the palette rails 221 formed on top of the truck body 22. The palette 23, to which the ship 4 hoisted by the raising/lowering lift 1 is unloaded, is separated from the truck body 22 so as to be able to be preserved at an appropriate safekeeping place. The palette 23, on which the ship 4 is placed, is stacked on the truck body 22 so as to be able to transfer another ship 4. To this end, the palette 23 includes a set of truck-side support blocks 231, a set of palette rail grooves 232, and a set of palette moving rollers 2321.

The truck-side support blocks 231 are places on which the ship 4, hoisted by the raising/lowering lift, 1 is placed, and is made up of a plurality of truck-side support blocks on opposite sides of the palette 23 which are spaced apart from each other at regular intervals. When the truck body 22 moves to the interior of the raising/lowering lift 1, and then the lift platforms 11 move up and down, the truck-side support blocks 231 pass through the gaps between the lift-side support blocks 112 which are formed on the lift platforms 11 and are spaced apart from each other, and thereby the ship 4 placed on the lift platforms 11 is transferred to the palette 23. In order to safely unload the ship from the lift platforms 11 to the palette 23, each truck-side support block 231 is provided with a support seat 2311, which is directly contacted with the ship 4.

The support seat 2311 is generally shaped similar to the lower outer surface of the hull of the ship 4, because the lower outer surface of the hull of the ship 4 has a variety of shapes according to the kind of ship 4. The support seat 2311 can come into contact with the lower outer surface of the hull of the ship 4 when the ship 4 placed on the lift platforms 11 is unloaded onto the support seat 1121 so as to be able to safely transfer the ship 4.

Each of the palette rail grooves 232 is preferably formed in a quadrilateral shape at predetermined left-hand and right-hand positions of a lower surface of the palette 23 so as to correspond to the palette rails 221, and includes a set of palette moving rollers 2321, which allows the palette 23 located on the palette rail grooves 232 to be separated from the truck body 22 as needed.

Each of the palette moving rollers 2321 preferably has the shape of a wheel for a railroad train, and is made up of a plurality of palette moving rollers in the palette rail grooves 232 so as to come into direct contact with the palette rails 221 and to allow the palette 23 to be separated from the truck body 22 as needed.

FIGS. 6 and 7 are a perspective view and a front view illustrating a set of movable rails in an apparatus for hoisting a ship according to an exemplary embodiment of the present invention.

Referring to FIGS. 6 and 7, the movable rails 3 are located aside of the raising/lowering lift 1, and includes a set of rails 31, a set of rail fixing frames 32, a set of inner transfer frames 33, a set of outer transfer frames 34, and a set of rail supports 35. In the case in which the transfer truck 2 that is located on the shore does not move to the interior of the raising/lowering lift 1 that is installed on the waterside, the movable rails 3 having the rails 31, which will be described below, moves to the interior of the raising/lowering lift 1, and thus allows the transfer truck 2 to move forwards to the interior of the raising/lowering lift 1.

The rails 31 are preferably formed in two rows in a shape similar to a railroad such that the truck body 22 can move. When the truck body 22 enters the interior of the raising/lowering lift 1, the rails 31 of the movable rails 3 are aligned with the rails of the stationary rails 21 installed on the shore such that the truck body 22 can move forwards along the rails 31 of the movable rails 3.

Each rail fixing frame 32 is formed as a rectangular frame having a "C" shape on the whole. The rails 31 are fixed to an upper side of each rail fixing frame 32, and the rail fixing frames 32 move along the inner and outer transfer frames 33 and 34, which will be described below. When the transfer truck 2 enters the raising/lowering lift 1, the rail fixing frames 32 allow the rails 31 located thereon to enter the interior of the raising/lowering lift 1, thereby allowing the transfer truck 2 to easily enter the raising/lowering lift 1.

The inner and outer transfer frames 33 and 34 are preferably formed as a rectangular frame having a "C" shape. The inner transfer frames 33 are installed inside the raising/lowering lift 1, while the outer transfer frames 34 are installed outside the raising/lowering lift 1. When the transfer truck 2 located on the shore enters the interior of the raising/lowering lift 1 located on the waterside, the rails 31 move from the outer transfer frames 34 to the inner transfer frames 33 located inside the raising/lowering lift 1, so that the transfer truck 2 can enter the interior of the raising/lowering lift 1. The inner and outer transfer frames 33 and 34 include transfer frame rollers 331 and transfer frame support posts 332.

The transfer frame rollers 331 are fixed to inner sides of the inner and outer transfer frames 33 and 34, and allow the rails 31 of the movable rails 3, which are fixed to the upper sides of the rail fixing frames 32, to be aligned with the rails of the stationary rails 21 when the transfer truck 2 enters the interior of the raising/lowering lift 1. Thus, the rail fixing frames 32 coupled with the rails 31 ride on the transfer frame rollers 331 to move to the interior of the raising/lowering lift 1.

The transfer frame support posts 332 are preferably formed as a rectangular frame having a "C" shape, and are spaced apart from each other at regular intervals under the inner and outer transfer frames 33 and 34.

The rail supports 35 are preferably formed as a rectangular frame having a "C" shape, are connected between the rail fixing frames 32 so as to be able to support the rails 31. The rail supports 35 can support loads of the rails 35 and the truck body 22 of the transfer truck 2 when the truck body 22 enters the interior of the raising/lowering lift 1 to move on the rails 31 installed on the rail supports 35.

Hereinafter, the operation of the apparatus for hoisting a ship according to an exemplary embodiment of the present invention will be described in detail with reference to the accompanying drawings.

FIGS. 8 through 10 are operational views illustrating the state in which a raising/lowering lift in an apparatus for hoisting a ship according to an exemplary embodiment of the present is lowered. FIG. 11 is an operational view illustrating the state in which a raising/lowering lift in an apparatus for hoisting a ship according to an exemplary embodiment of the present is raised. FIGS. 12 and 13 are operational views illustrating the state in which a movable rail in an apparatus for hoisting a ship according to an exemplary embodiment of the present moves forwards. FIG. 14 is a front view illustrating an apparatus for hoisting a ship according to another exemplary embodiment of the present invention.

Referring to FIGS. 8 through 10, the raising/lowering lift 1 is installed on the waterside, and is for hoisting the ship 4 floating on the water surface. As illustrated in FIG. 8, the lift guides 12 are made up of four lift guides, and the lift platforms 11 are fixed. The rails 31 of the movable rails 3 are installed on the outer transfer frames 34 located outside the raising/lowering lift 1. As illustrated in FIG. 9, the transfer truck 2 is disposed on the stationary rails 21 installed on the shore. As illustrated in FIG. 8, the lift-side support blocks 112 of the lift platforms 11 are places where the ship 4 is hoisted and placed, and are made up of a plurality of lift-side support blocks on one side of each lift frame 111, on the other side of which the roller fixtures 111 and the lift rollers 1112 are located, wherein the lift-side support blocks are spaced apart from each other at regular intervals. Each support seat 1121 is provided with a set of seat rollers 1122. Thus, as illustrated in FIG. 10, when the lift platforms 11 are raised in the state in which the central lines of the lift platforms 11 deflect from the central line of the ship 4, the ship 4 is placed on the lift-side support blocks 112 of the lift platforms 11 in the state where the left-hand and right-hand sides thereof are unbalanced. In this case, the seat rollers 1122 come into contact with the lower outer surface of the hull of the ship 4, and balance the left-hand and right-hand sides of the ship 4 by means of rotation thereof.

Referring to FIG. 14 illustrating another embodiment, although each support seat 1121 does not have the seat rollers 1122, the unbalanced ship 4 is directly placed on the support seats 1121, and then the left-hand and right-hand sides of the ship 4 can be balanced by its own weight. Further, according to another embodiment of the lift-side support blocks 112, each lift-side support block 112 includes the support guard 1123 on the upper surface thereof which extends from each support seat 1121 thereof. The support guards 1123 prevent the ship 4 from moving backwards and forwards or from side to side because of the waves or the wind when the ship 4 is hoisted.

Referring to FIG. 11, when the ship 4 is located inside the raising/lowering lift 1, and then the motor 1241*a* of the driver 1241 is powered to raise the lift platforms 11, the chains 14 between the fixing axles 122 located in the "A" and "B" directions moves in the "A" direction. Thereby, the lift platforms 11 are raised by the chains 14 fixed to the roller fixtures 1111 thereof located in the "B" direction. Thus, the two strings of chains 14 between the balance weight 13 and the fixing axle 122 located in the "A" direction move downward, so that the balance weight 13 is lowered. In this manner, the other two strings of chains 14 between the balance weight 13 and the fixing axle 122 located in the "A" direction raise the lift platforms 11 located in the "A" direction.

Referring to FIGS. 12 and 13, the ship 4 placed on the lift platforms 11 is transferred to the transfer truck 2. As illustrated in FIG. 12, the raising/lowering lift 1 is installed on the waterside, and the transfer truck 2 is located on the shore. Thus, the transfer truck 2 cannot enter the interior of the raising/lowering lift 1. As illustrated in FIG. 13, the rails 31 of the movable rails 3 move to the interior of the raising/lowering lift 1 by means of the inner and outer transfer frames 33 and 34 so as to be aligned with the rails of the stationary rails 21 installed on the shore. The transfer truck 2 is configured such that the lift-side support blocks 112, which are installed on the lift platforms 11 of the raising/lowering lift 1 and are spaced apart from each other at regular intervals, are positioned so as to pass through the gaps between the truck-side support blocks 231 which are installed on the transfer truck 2 and are spaced apart from each other at regular intervals like the lift-side support blocks 112. Thus, when the lift platforms 11 move from the top to the bottom, the lift-side support blocks 112 pass through the gaps between the truck-side support blocks 231, and thus the ship 4 placed on the lift platforms 11 can be safely unloaded onto the palette 23.

In contrast, when the ship 4 located on the palette 23 of the transfer truck 2 is transferred to the waterside, this process is the opposite of the aforementioned process. Thus, this process will be omitted in order to avoid obscuring the subject matter of the present invention.

In the drawings and specification, typical exemplary embodiments of the invention have been disclosed, and although specific terms are employed, they are used in a generic and descriptive sense only and are not for the purposes of limitation, the scope of the invention being set forth in the following claims.

The invention claimed is:

1. An apparatus for hoisting a ship, comprising:

a raising/lowering lift, which hoists the ship floating on a water surface under water;

wherein the raising/lowering lift includes a set of two vertically movable lift platforms, the two lift platforms being separated from each other by a gap;

a transfer truck, which moves forwards to an interior of the raising/lowering lift, receives the hoisted ship for unloading, moves backwards to transfer the unloaded ship to a shore, and includes a truck body moving backwards and forwards, and a palette detachably installed on the truck body; and a set of movable rails, which is displaced to allow the transfer truck to move forwards to the interior of the raising/lowering lift.

2. The apparatus as set forth in claim 1, wherein each of the lift platforms includes a set of lift-side support blocks spaced apart from each other.

3. The apparatus as set forth in claim 2, wherein the lift-side support blocks are shaped so as to correspond to a lower outer surface of a hull of the ship.

4. The apparatus as set forth in claim 2, wherein each of the lift-side support blocks further includes a support guard, which extends from an upper surface thereof such that the ship is not unbalanced by waves.

5. The apparatus as set forth in claim 2, wherein the palette has a width smaller than that of each lift-side support block.

6. The apparatus as set forth in claim 2, wherein the lift-side support blocks include rollers enabling left-hand and right-hand sides of the ship to be balanced when the ship is placed on the lift-side support blocks.

7. The apparatus as set forth in claim 2, wherein the truck body includes a plurality of truck-side support blocks spaced apart from each other.

8. The apparatus as set forth in claim 3, wherein the lift-side support blocks include rollers enabling left-hand and right-hand sides of the ship to be balanced when the ship is placed on the lift-side support blocks.

9. The apparatus as set forth in claim 4, wherein the lift-side support blocks include rollers enabling left-hand and right-hand sides of the ship to be balanced when the ship is placed on the lift-side support blocks.

10. The apparatus as set forth in claim 1, wherein the raising/lowering lift further includes a set of lift guides guiding upward and downward movement of the lift platforms, a set of chains transmitting driving force of a driver such that the lift platforms move up and down, and a balance weight connected with the chains and making possible the upward and downward movement of the lift platforms.

11. The apparatus as set forth in claim 1, wherein the movable rails include rails transferring the transfer truck, outer transfer frames provided outside the raising/lowering lift, and inner transfer frames provided inside the raising/lowering lift.

12. The apparatus as set forth in claim 11, wherein the rails of the movable rails move between the outer transfer frames and the inner transfer frames.

13. The apparatus as set forth in claim 7, wherein the truck-side support blocks are shaped so as to correspond to a lower outer surface of a hull of the ship.

14. The apparatus as set forth in claim 7, wherein the lift-side support blocks and the truck-side support blocks cross each other through gaps, which are defined in an overlapping manner when the lift-side support blocks are lowered after the truck-side support blocks move forwards to the interior of the raising/lowering lift.

15. An apparatus for hoisting a ship, comprising:

a raising/lowering lift, which hoists the ship floating on a water surface under water;

wherein the raising/lowering lift includes a set lift platforms, each of the lift platforms comprising a set of lift-side support blocks spaced apart from each other;

a transfer truck, which moves forwards to an interior of the raising/lowering lift, receives the hoisted ship for unloading, moves backwards to transfer the unloaded ship to a shore, and includes a truck body moving backwards and forwards, and a palette detachably installed on the truck body;

wherein the truck body includes a plurality of truck-side support blocks spaced apart from each other and;

a set of movable rails, which is displaced to allow the transfer truck to move forwards to the interior of the raising/lowering lift; and wherein the lift-side support blocks and the truck-side support blocks cross each other through gaps, which are defined in an overlapping manner when the lift-side support blocks are lowered after the truck-side support blocks move forwards to the interior of the raising/lowering lift.

16. An apparatus for hoisting a ship, comprising:

a raising/lowering lift, which hoists the ship floating on a water surface under water;

a transfer truck, which moves forwards to an interior of the raising/lowering lift, receives the hoisted ship for unloading, moves backwards to transfer the unloaded ship to a shore, and includes a truck body moving backwards and forwards, and a palette detachably installed on the truck body;

a set of movable rails, which is displaced to allow the transfer truck to move forwards to the interior of the raising/lowering lift; and wherein the movable rails include rails transferring the transfer truck, outer transfer frames provided outside the raising/lowering lift, and inner transfer frames provided inside the raising/lowering lift.

17. The apparatus as set forth in claim 16, wherein the rails of the movable rails move between the outer transfer frames and the inner transfer frames.

* * * * *